United States Patent [19]

Wood

[11] 4,186,867

[45] Feb. 5, 1980

[54] MEANS FOR PREVENTING THE DISFIGUREMENT OF BOTTLE LABELS

[75] Inventor: Prentice J. Wood, Hapeville, Ga.

[73] Assignee: The Mead Corporation, Dayton, Ohio

[21] Appl. No.: 933,488

[22] Filed: Aug. 14, 1978

[51] Int. Cl.[2] ..... B65D 75/72; B65D 1/22

[52] U.S. Cl. ..... 229/40; 229/28 BC

[58] Field of Search ..... 229/28 BC, 52 BC, 40

[56] References Cited

U.S. PATENT DOCUMENTS

| | | | |
|---|---|---|---|
| 2,314,895 | 3/1943 | Powell | 229/52 BC X |
| 2,684,759 | 7/1954 | Freeman | 229/52 BC X |
| 3,176,902 | 4/1965 | Champlin | 229/40 |
| 3,498,449 | 3/1970 | Spery | 229/40 X |
| 4,007,830 | 2/1977 | Calvert | 229/28 BC X |
| 4,029,204 | 6/1977 | Manizza | 229/40 |
| 4,096,985 | 6/1978 | Wood | 229/40 |
| 4,146,168 | 3/1979 | Hartline | 229/28 BC |

FOREIGN PATENT DOCUMENTS

| | | | |
|---|---|---|---|
| 952072 | 7/1974 | Canada | 229/28 BC |

*Primary Examiner*—Davis T. Moorhead

*Attorney, Agent, or Firm*—Walter M. Rodgers; Walter A. Rodgers

[57] ABSTRACT

A preformed sleeve type bottle carrier is provided and is arranged for loading at least two bottles through at least one side of the sleeve and has a bottom wall (1) with the two bottles disposed thereon and with a label (L) affixed to the outer surface of at least one of the bottles. According to the invention, means is provided for preventing the disfigurement of the label and comprises a label saving tab (57–64) struck from the bottom wall and joined thereto along a fold line (65–72) disposed generally perpendicular to the side edge of the bottom wall, the label saving tab having a cutaway portion disposed in the upper outer corner of the tab, and the cutaway portion comprising a primary edge (P) disposed below the lowermost part of the label.

6 Claims, 3 Drawing Figures

MEANS FOR PREVENTING THE DISFIGUREMENT OF BOTTLE LABELS

TECHNICAL FIELD

This invention relates to the packaging of multiple bottles with sufficient and effective separation therebetween.

BACKGROUND ART

It is known to package multiple bottles in a preformed sleeve type carrier having separating tabs foldably joined to the bottom wall of the carrier for the purpose of providing separation between the heel portions of adjacent bottles. Since the bottles are moved into the carrier through an open side thereof by means of high speed machinery, a bottle label may come into contact with the outer edge of the associated separating tab. Of course this is likely to cause undesirable tearing and disfigurement of the label.

DISCLOSURE OF INVENTION

In a preformed sleeve type bottle carrier arranged for loading at least two bottles having labels through an open side wall of the sleeve and including a bottom wall with two bottles disposed thereon, a label saving tab is struck from the bottom wall and joined thereto along a transverse fold line disposed perpendicular to the side wall, the label saving tab being interposed between the two bottles, and the label saving tab having a cutaway portion disposed in the upper outer corner of the tab and defined by a primary edge disposed below the lowermost part of the label.

BEST MODE FOR CARRYING OUT THE INVENTION

Figure 2:
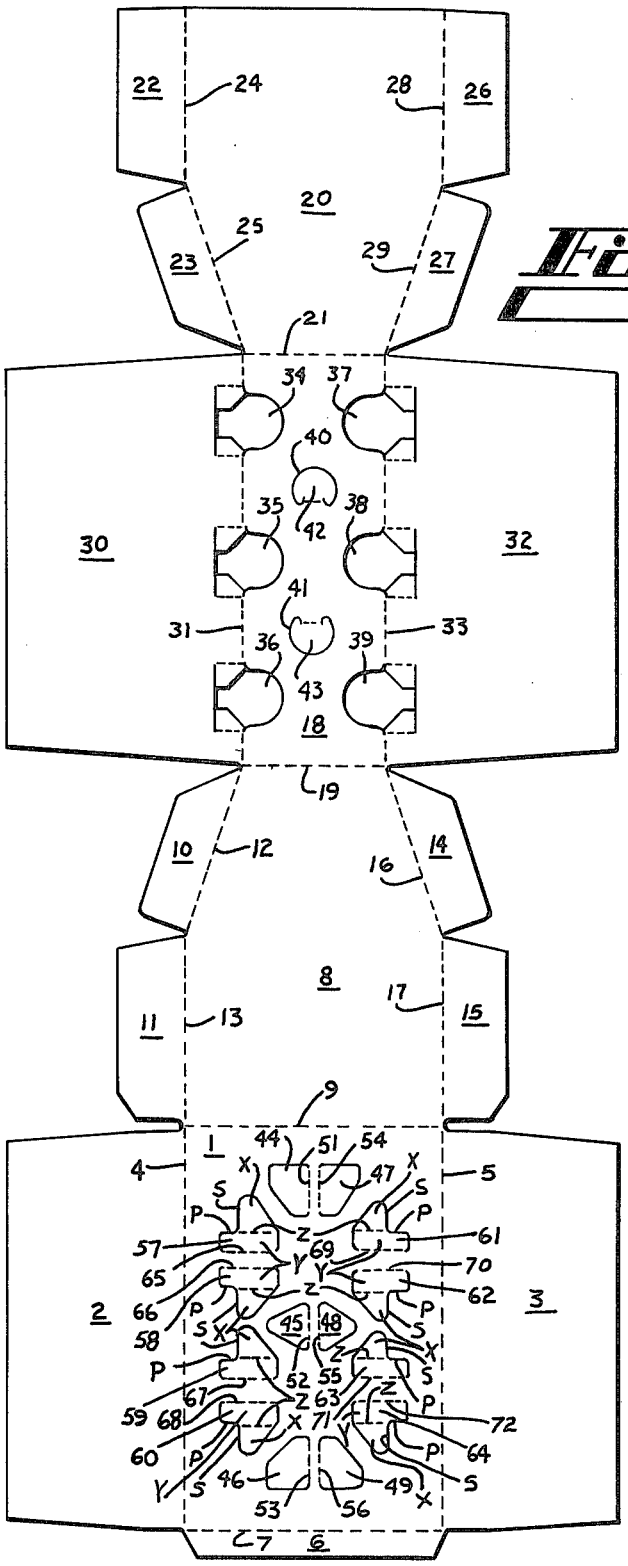
FIG. 2 is a plan view of a blank from which the bottle carrier shown in FIG. 1 is formed.

With reference to the drawings and with particular reference to FIG. 2, the numeral 1 designates the bottom wall of the carrier to the side edges of which lower side wall panels 2 and 3 are foldably joined along fold lines 4 and 5 respectively. In addition glue flap 6 is foldably joined to an end edge of bottom wall 1 along fold line 7. To the opposite end edge of bottom wall 1, end wall 8 is foldably joined along fold line 9. Also glue flaps 10 and 11 are foldably joined to an end edge of end wall 8 along fold lines 12 and 13 respectively. In like manner glue flaps 14 and 15 are foldably joined to the opposite end edge of end wall 8 along fold lines 16 and 17 respectively.

Top wall 18 is foldably joined to the top edge of end wall 8 along fold line 19 and, in similar fashion, end wall 20 is foldably joined to top wall 18 remote from end wall 8 along fold line 21. In addition glue flaps 22 and 23 are foldably joined to an end edge of end wall 20 along fold lines 24 and 25 respectively. Also to the opposite end edge of end wall 20, glue flaps 26 and 27 are foldably joined along fold lines 28 and 29 respectively.

To complete the basic elements of the blank, upper side wall panel 30 is foldably joined to top wall 18 along interrupted fold line 31 and, similarly, upper side wall panel 32 is foldably joined to the opposite side edge of top wall 18 along interrupted fold line 33. For the purpose of receiving the necks of the packaged bottles, apertures 34, 35 and 36 are provided and are formed in top wall 18 and upper side wall panel 30. In like fashion apertures 37, 38 and 39 are provided and are formed in top wall 18 and upper side wall panel 32. For the purpose of facilitating transport of the carrier, finger receiving apertures 40 and 41 defined by cushioning tabs 42 and 43 respectively are provided in top wall 18.

To provide proper cushioning between adjacent bottles in the transverse direction of the carrier, longitudinal cushioning tabs 44–49 are struck from bottom wall 1 and are foldably joined thereto along fold lines 51–56, respectively, which extend parallel and adjacent to the longitudinal center line of bottom wall 1. In order to provide proper separation between bottles in the longitudinal direction of the carrier, label saving tabs 57–64 are struck from bottom wall 1 and are foldably joined thereto along spaced transverse fold lines 65–72 respectively. Preferably the cushioning tabs and label saving tabs are arranged in pairs such as 44 and 47, 45 and 48, 46 and 49, 57 and 58, 59 and 60, 61 and 62, as well as 63 and 64 to provide a double thickness of paperboard between adjacent bottles.

Figure 3:
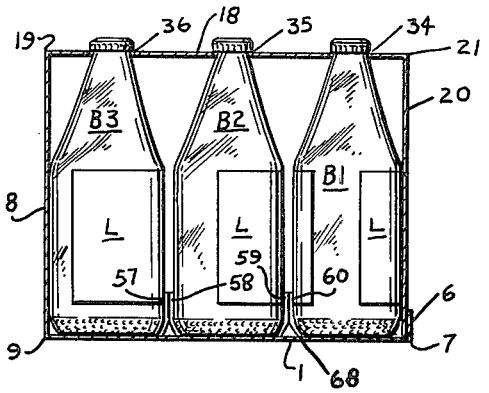
FIG. 3 is a side view of a fully loaded bottle carrier with the side walls thereof removed for purposes of clarity.
Figure 1:
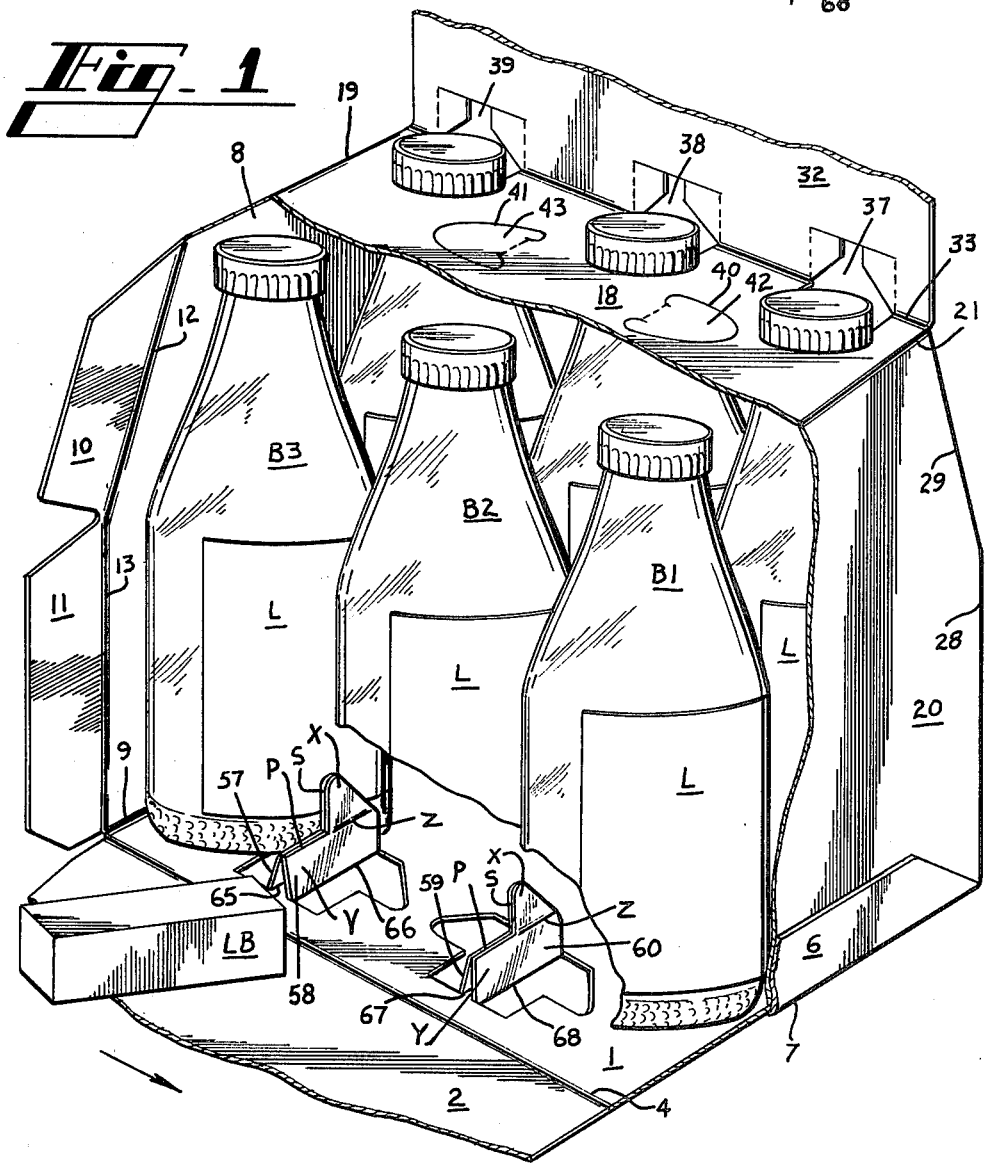
FIG. 1 is an isometric view of a loaded bottle carrier formed according to this invention with portions thereof broken away together with a portion of the bottle loading machinery.

According to one facet of this invention, each label saving tab is provided with a cutaway portion defined by a primary edge P each of which is generally parallel to the fold lines 65–72 and by a secondary edge S which extends upwardly from the inner end of each primary edge P. Therefore it can be seen that primary edge P and secondary edge S form a cutaway portion on the upper outer corner of each label saving tab 57–64. As best seen in FIG. 1, each label saving tab comprises an inwardly disposed portion X and a wider base portion Y. Portion X is joined to base portion Y along fold line Z which is in alignment with edge P.

In order to initially form the carrier from the blank shown in FIG. 2, glue is applied to glue flap 6 by the carrier manufacturer which is then adhered to end wall 20 in known manner. A sleeve is formed by the bottler by placing the various parts of the blank in dispositions whereby the top and bottom walls are parallel to each other and, likewise, whereby the two end walls are parallel to each other. Following this the various cushioning tabs and label saving tabs are elevated to vertical positions. In general bottles are then guided into the carrier by means of loading bar LB which forms a part of the bottle loading machinery and functions in known manner. In FIG. 1 loading bar LB is shown in a position relative to the carrier after all the bottles have been loaded into one side of the carrier.

With particular reference to the loading of bottle B1, it is moved toward the carrier and strikes the loading bar LB which in turn initiates rotation of the bottle in a clockwise direction as viewed from above. Bottle B1 then travels in a transverse direction and strikes the associated label saving tab 60. Since primary edge P of label saving tab 60 is disposed below the lowermost part of label L, no contact occurs between the leading edge of label saving tab 60 and the label L and any initial tearing of the label is thereby prevented.

Fold line 68 of label saving tab 60 is spaced from end wall 20 by a distance somewhat less than the diameter of bottle B1 and is thus located below the junction between the flat center portion of the bottle bottom and its rounded heel when in place in the carrier. Tabs 58 and 59 are similarly related to bottle B2 and tab 57 is related to bottle B3 when the bottles are disposed in the carrier. As bottle B1 proceeds inwardly, label saving tab 60 is caused to bend away from bottle B1. Therefore as secondary edge S of label saving tab 60 approaches label L, contact therebetween is prevented since label saving tab 60 is angularly disposed with respect to the vertical outer edge of bottle B1. As the adjacent bottle B2 enters the carrier, label saving tab 59 is forced into an angular position against label saving tab 60 and as the bottle proceeds top portions X of label saving tabs 60 and 59 are pressed into vertical positions against the vertical outer walls of bottles B1 and B2 respectively and assume an angular relation with respect to the associated base portions Y.

The bottle B3 is loaded into the carrier in similar fashion as discussed above in connection with bottles B1 and B2 and the adjacent longitudinal row of articles is likewise loaded from the opposite side of the carrier. Although the above discussion deals with a carrier which is loaded through the sides thereof, it is understood that this invention is well suited to a carrier which is loaded through the sleeve ends.

After the bottles are fully loaded into the carrier, glue flaps 10, 11, 14, 15, 22, 23, 26 and 27 are folded inwardly and glue is applied thereon in known manner. Subsequently the lower side wall panels 2 and 3 and upper side wall panels 30 and 32 are folded inwardly of the carrier. By these operations the side walls become adhered to the appropriate glue flaps. In addition lower side wall panels 2 and 3 as well as upper side wall panels 30 and 32 are adhered to each other at the respective points of overlap. The formation of the loaded carrier is then complete.

INDUSTRIAL APPLICABILITY

By this invention a bottle carrier is provided which is especially adapted to prevent the unsightly disfigurement of bottle labels due to contact between the outer edge of a separating tab and the associated label as the bottle is loaded into the bottle carrier.

The embodiments of the invention in which an exclusive property or privilege is claimed are defined as follows:

1. In a preformed sleeve type bottle carrier arranged for loading at least two bottles having labels through an open side wall of the sleeve and including a bottom wall (1) with two bottles disposed thereon, a label saving tab (57–64) struck from said bottom wall and being joined thereto along a transverse fold line (65–72) disposed perpendicular to the side wall and interposed between said two bottles, and characterized in that said label saving tab has a cutaway portion disposed in the upper outer corner of said tab, and said cutaway portion is defined by a primary edge (P) disposed below the lowermost part of the label of the associated one of said bottles.

2. Means according to claim 1 and further characterized in that the bottoms of said bottles have substantially flat center portions and rounded heels and said transverse fold line is disposed between an imaginary plane tangent to the associated outermost point of said one bottle and the axis of said one bottle.

3. Means according to claim 2 and further characterized in that said primary edge is horizontal.

4. In a preformed sleeve type bottle carrier arranged for loading at least two bottles having labels through an open side wall of the sleeve and including a bottom wall (1) with two bottles disposed thereon, a label saving tab (57–64) struck from said bottom wall and being joined thereto along a transverse fold line (65–72) disposed perpendicular to the side wall and interposed between said two bottles, and characterized in that said label saving tab has a cutaway portion disposed in the upper outer corner of said tab, said cutaway portion is defined by a primary edge (P) disposed below the lowermost part of the label of the associated one of said bottles, and said cutaway portion comprises a secondary edge (S) extending vertically upward from the inner end of said primary edge.

5. In a preformed sleeve type bottle carrier arranged for loading at least two bottles having labels through an open side wall of the sleeve and including a bottom wall (1) with two bottles disposed thereon, a label saving tab (57–64) struck from said bottom wall and being joined thereto along a transverse fold line (65–72) disposed perpendicular to the side wall and interposed between said two bottles, and characterized in that said label saving tab has a cutaway portion disposed in the upper outer corner of said tab, said cutaway portion is defined by a primary edge (P) disposed below the lowermost part of the label of the associated one of said bottles, and said label saving tab comprises a base portion (Y) and a top portion (X) foldably joined together and disposed in angular relation to each other.

6. Means according to claim 5 and further characterized in that the fold line between said base and top portions is disposed in substantial alignment with said primary edge.

* * * * *